US008792659B2

(12) United States Patent
Ypma et al.

(10) Patent No.: US 8,792,659 B2
(45) Date of Patent: Jul. 29, 2014

(54) ASYMMETRIC ADJUSTMENT

(75) Inventors: Alexander Ypma, Veldhoven (NL); Aalbert de Vries, Eindhoven (NL); Joseph Renier Gerardus Maria Leenen, Veldhoven (NL); Job Geurts, Eindhoven (NL)

(73) Assignee: GN Resound A/S, Ballerup (DK)

( * ) Notice: Subject to any disclaimer, the term of this patent is extended or adjusted under 35 U.S.C. 154(b) by 1008 days.

(21) Appl. No.: 12/264,546

(22) Filed: Nov. 4, 2008

(65) Prior Publication Data

US 2010/0111338 A1 May 6, 2010

(51) Int. Cl.
*H04R 25/00* (2006.01)

(52) U.S. Cl.
USPC ..... 381/314; 381/59; 381/60; 381/312; 381/313; 381/320

(58) Field of Classification Search
USPC ..... 381/312, 313, 314, 315
See application file for complete search history.

(56) References Cited

U.S. PATENT DOCUMENTS 6,549,633 B1 * 4/2003 Westermann ..... 381/312
7,242,777 B2 * 7/2007 Leenen et al. ..... 381/60
2005/0069162 A1 * 3/2005 Haykin et al. ..... 381/312
2007/0291969 A1 * 12/2007 Tateno et al. ..... 381/315
2010/0008526 A1 * 1/2010 De Vries et al. ..... 381/314
2010/0040247 A1 * 2/2010 Ypma et al. ..... 381/314
2010/0135500 A1 * 6/2010 Derleth et al. ..... 381/23.1

FOREIGN PATENT DOCUMENTS

WO WO2007110073 * 3/2007
WO WO2007042043 * 4/2007

OTHER PUBLICATIONS

Alexander Ypma et al., Online Personalization of Hearing Instruments, EURASIP Journal on Audio, Speech, and Music Processing, Dec. 27, 2007, pp. 1-14pgs., Hindawi Publishing Corporation.

* cited by examiner

*Primary Examiner* — Minh-Loan T Tran
*Assistant Examiner* — Fazli Erdem
(74) *Attorney, Agent, or Firm* — Vista IP Law Group, LLP

(57) ABSTRACT

A method of adjusting a signal processing parameter for a first hearing aid and a second hearing aid forming parts of a binaural hearing aid system to be worn by a user is provided. The binaural hearing aid system comprises a user specific model representing a desired asymmetry between a first ear and a second ear of the user. The method includes detecting a request for processing a parameter change at the first hearing aid, adjusting the signal processing parameter in the first hearing aid, and adjusting a processing parameter for the second hearing aid based on the request for processing parameter change and the user specific model.

30 Claims, 9 Drawing Sheets

ASYMMETRIC ADJUSTMENT

FIELD

The present specification relates to a method of adjusting processing parameters in hearing aids, in particular in a binaural hearing aid system.

BACKGROUND AND SUMMARY

If a hearing impaired user is wearing a left and a right hearing aid, it is often desired that the hearing aids operate in a somehow synchronized manner. The questions are: how much synchronization is desired, what type of synchronization is desired and in which circumstances does one need which type of synchronization. A complicating issue is that it may be difficult to predefine the desired synchronization after a fitting session, since preferences concerning the symmetry of the binaural hearing aid system may be depending on environment, may be changing throughout the usage period, or may simply be hard to predefine based on a laboratory fitting procedure.

A recent study, published as "Online Personalization of Hearing Instruments," EURASIP Journal on Audio, Speech, and Music Processing, vol. 2008, Article ID 183456, 14 pages, 2008. doi:10.115512008/183456, by Alexander Ypma, Job Geurts, Serkan Özer, Erik van der Werf, and Bert de Vries, where a group of 10 hearing impaired users were asked to personalize a noise reduction parameter on both instruments revealed that some participants had a preference to asymmetry in the binaural hearing aid system.

Currently in order to configure a binaural hearing aid system a user need to adjust both the left and the right hearing aid Individually. This two-sided user Interaction with the hearing aid system is contemplated to be a burden on the user.

Left and right hearing aids may communicate with each other, e.g. via a wireless link between the hearing aids. With such a configuration one could use the combined knowledge on symmetric and asymmetric left-right preferences by synchronizing the hearing aids in an asymmetric way, i.e. benefit from the ease of synchronization, but at the same time allowing asymmetric preferences.

Additionally, a model for asymmetric hearing loss and/or preferences may be used for predicting asymmetric parameter changes. Furthermore, user adjustments to one of the hearing aids could be used to infer adjustments to the other instrument in the binaural hearing aid system or even to update the settings of the binaural hearing aid system based on only partial (left- or right instrument) input.

A first aspect of present embodiments provides a method of adjusting a signal processing parameter for a first and a second hearing aid forming part of a binaural hearing aid system to be worn by a user, the binaural hearing aid system comprising a user specific model representing a desired asymmetry between the first ear and the second ear of the user is provided, the method comprising the steps of:

- detecting a request for processing parameter change at the first hearing aid,
- adjusting the signal processing parameter in the first hearing aid,
- adjusting a processing parameter for the second hearing aid based on the request for processing parameter change and the user specific model The step of detecting may include recording a signal or request for change of parameter, e.g. via a hardware interrupt or other signaling means.

When a person operates one of the hearing aids via some control, e.g. an actuator such as a control wheel (e.g. a volume wheel), a push button, a toggle switch or some remote device that controls the hearing aid, the method according to the present embodiments synchronizes the other hearing aid with the first hearing aid, but preferably not by simply copying the same adjustment to the other hearing aid. The method according to the present embodiments ensures that differences in preferences and hearing loss in the two ears are taken into account. The model may be based on measurements by e.g. audiogram or some derivative thereof like PTA. PTA is pure tone average i.e. the average of pure tone hearing thresholds at e.g. 500, 1000, and 2000 Hz.

The role of a first and a second hearing aid may be played interchangeably by both the left and right hearing aid in a binaural hearing aid system.

The model used in the method according to the first aspect may be a frequency dependent model. This may be advantageous as hearing loss may not be uniform in the entire frequency spectrum or over a given frequency interval.

It is understood that the term hearing loss may be construed to mean hearing loss in the first and/or second ear. In other embodiments the term hearing loss may be construed to mean the difference in the hearing losses between the first and second ear and may possibly also include other type of data that e.g. may reflect any desired asymmetry.

In the method according to the present embodiments, a request for change of processing parameter is detected. The request may originate from one of several events or a combination of events, including but not limited to operation of a wheel on one of the hearing aids, a push-button on one of the hearing aids, operation of a remote control controlling or communicating with one or both of the hearing aids, a device monitoring ambient sound or any combinations hereof.

The request is processed and the corresponding parameter, or parameters, is adjusted in the first hearing aid. A corresponding adjustment of the second hearing aid is calculated, predicted or determined on the basis of the request and by using a model or rule representing the hearing loss and/or preferences of the second ear. The processing parameter for the second hearing aid is then adjusted accordingly.

The method according to the present embodiments make use of prior knowledge on the hearing loss in each ear and other audiological or psychophysical prior knowledge and environmental information in doing the synchronized adjustment in an asymmetric manner.

It is an advantage that the signal processing parameter in the first hearing aid may be adjusted based on the request for processing parameter change and further by using a further specific model representing the hearing loss of the first ear of the wearer. This allow adjustment of the hearing aid processing parameter of the first hearing aid to be adjusted using a model or rule representing the hearing loss both in the first ear as well as in the second ear. When synchronizing the level of steering parameters an advantage is that constraining identical steering parameters on both sides of the hearing aid system can still be looked upon as asymmetric synchronization. This is because asymmetry between left and right hearing aid parameters may be caused by different acoustic fields at the two ears. Steering parameters are parameters that govern the computation of hearing aid processing parameters from environmental descriptors like sound features or sound classification outputs. Steering parameters may also be parameters that relate sound environment to hearing aid processing parameters. These may not be fixed to a certain value. The steering parameters may furthermore be modifiable in such a way that the values of the hearing aid parameter(s) in a certain environment reflect the user preference as good as possible Also, the user has to operate only one of the hearing aids, whereas both hearing aids are adjusted in a manner that is tailored to the left and right hearing loss.

As mentioned above, the request for processing parameter change may originate from a wearer initiated operation of an actuator or may be generated in response to changes in signal characteristics. The hearing aid may include the possibility to detect the ambient sound environment to detect present sound environment conditions, such as noisy conditions e.g. due to wind noise or noise originating from surrounding speech or other ambient noise sources.

In some embodiments the processing parameter may be volume level, but other parameters may be used, such as equalizing parameters, sound classification parameters, noise reduction parameters, noise reduction, compression ratio, time constants, parameters of classifier module, beamforming (directional processing) parameters, feedback suppression parameters, dynamic range compression parameters and the like. Furthermore, hyperparameters may be controlled or changed. A hyperparameter is not a hearing aid processing parameter as such. It is a parameter that governs the working of a processing algorithm, and is typically fixed to a certain value.

It is a particular advantage of some embodiments that the model may be adapted in response to the request for processing parameter change. If a user or wearer is subjected to a particular environment situation and adjusts the hearing aid accordingly the model or rule may be adjusted or modified in response to that change request. This is contemplated to reduce the number of times a wearer needs to adjust a hearing aid, thereby possibly increasing the wearer satisfaction with the hearing aid.

It is further advantageous that the method according to the present embodiments provides the possibility that the request for processing parameter change may comprise information regarding one or more processing parameters to be changed and a parameter representing an amount of change. The request may comprise information regarding which parameter or parameters to change as well as the amount of change of that parameter or parameters, e.g. an amount of increase or decrease of volume.

In one embodiment the first hearing aid may be a master device and the second hearing aid may be a slave device. This allows a user to make a change at the first, master, hearing aid alone and the change will then be transferred or imposed on the second, slave, device. It is further possible that both hearing aids may assume the role of the master device, but not at the same time, in the meaning that both devices may receive change requests and subsequently transfer or apply the change to the other device.

In one advantageous embodiment, the model may comprise two separate steering vectors each associated with a hearing loss in the first and second ear of the user, respectively, which steering vectors are coupled by a probability model representing the combined binaural system.

In another advantageous embodiment of the method according to the first aspect the overall degree of asymmetry may further depend on the difference between microphone recordings in the first and second hearing aid.

According to some embodiments, the model representing the hearing loss of the user may comprise a measured or estimated hearing loss in the first and/or second ear of the user. This may be advantageous when hearing loss is not identical in the two ears.

In a still further advantageous embodiment, the request for processing parameter change may originate from a user initiated operation of an actuator or is generated in response to changes in signal characteristics. The request may e.g. originate from a volume wheel or other interaction means operated by a user.

In some embodiments, the method according to the first aspect not performed in a fitting situation. The fitting situation is usually performed by a technician e.g. at a laboratory or clinic. The method according to the present embodiments is preferably in use while the wearer is in any situation any other person would be, e.g. work, leisure situations such as dinners at restaurants, also larger groups of people gathered.

The method is preferably implemented in a hearing aid to be used by a wearer in any noisy situation where hearing impaired persons otherwise would feel discomfort without the hearing aid.

The request may be based on a vector of parameters. The models of the first and the second hearing aid may be a shared or common parameter or parameter set or vector.

A second aspect relates to a hearing aid comprising a signal processor, wherein the hearing aid is adapted for forming part of a binaural hearing aid system during use and for receiving information from another hearing aid that during use also is adapted to form part of the binaural hearing aid system, wherein the signal processor is configured to adjust a signal processing parameter in the hearing aid based on a request for a processing parameter change in the other hearing aid and a specific model representing a hearing loss of a user.

The hearing aid according to the second aspect may further be configured or adapted to perform any of the steps mentioned in relation to the method according to the first aspect of the embodiments.

The model may be placed in the first hearing aid or it may be placed in the second hearing aid. The model may however in an alternative embodiment be placed in a third device, such as a remote control, a personal portable device such as a body worn device or a PDA, Personal Data Assistant, a mobile/cellular phone or the like.

In an embodiment, the model may be shared between the first and the second hearing aid in such a way that some parts of the model are placed in the first hearing aid and some parts are placed in the second hearing aid. For example in one embodiment those parts of the model that relate to the hearing loss in the ear that is to be compensated with the first hearing aid are placed in the first hearing aid, while those parts of the model that relate to the hearing loss in the ear that is to be compensated by the second hearing aid are placed in the second hearing aid.

In another embodiment these parts of the model may be overlapping, and in some embodiments be totally overlapping, i.e. the first and the second hearing aid may both be equipped with the same model in the case of extreme overlap.

In accordance with some embodiments, a method of adjusting a signal processing parameter for a first hearing aid and a second hearing aid forming parts of a binaural hearing aid system to be worn by a user is provided. The binaural hearing aid system comprises a user specific model representing a desired asymmetry between a first ear and a second ear of the user. The method includes detecting a request for processing a parameter change at the first hearing aid, adjusting the signal processing parameter in the first hearing aid, and adjusting a processing parameter for the second hearing aid based on the request for processing parameter change and the user specific model.

In accordance with other embodiments, a hearing aid includes a signal processor, wherein the hearing aid is configured for forming a part of a binaural hearing aid system and for receiving information from an other hearing aid that is also configured to form a part of the binaural hearing aid system, wherein the signal processor is configured to adjust a signal processing parameter in the hearing aid based on a request for a processing parameter change in the other hearing aid and a specific model representing a hearing loss of a user.

DESCRIPTION OF THE DRAWING FIGURES

The present embodiments will now be disclosed in more detail with reference to the drawings in which:

FIG. 1 schematically illustrate a simplistic drawing of a binaural hearing aid system, FIG. 2 is a schematic illustration of a flow diagram illustrating the steps of a first embodiment.

Figure 5:
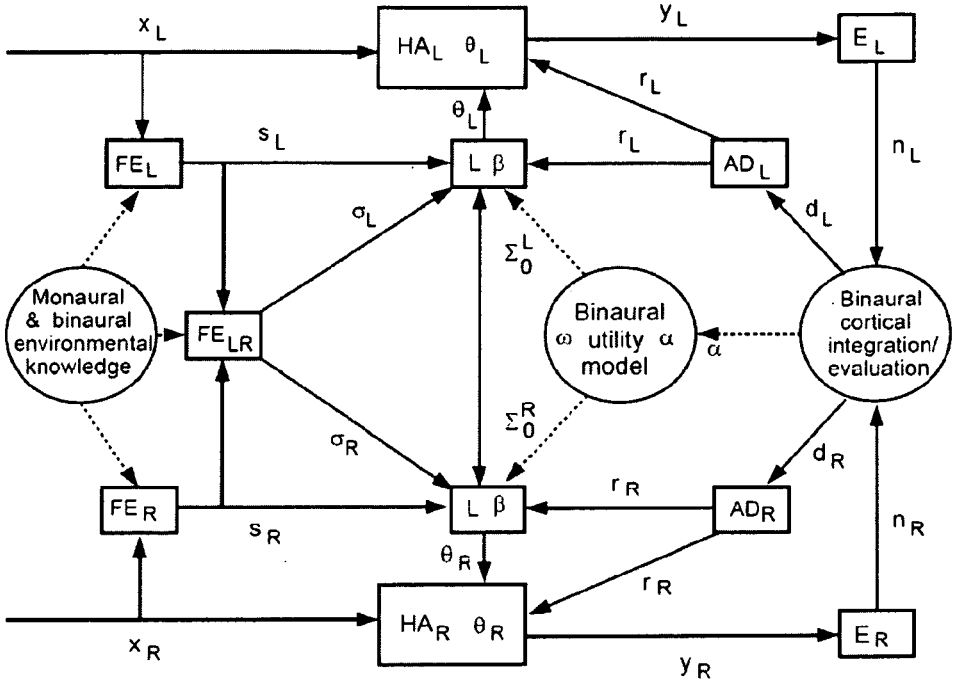

FIG. 5 schematically illustrate a second embodiment.

Figure 1:
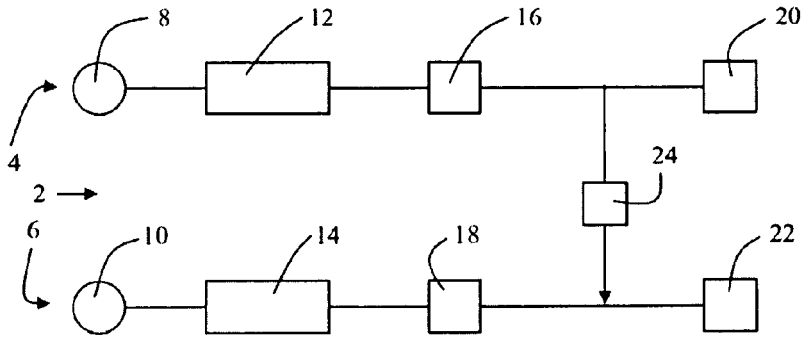
Figure 6:
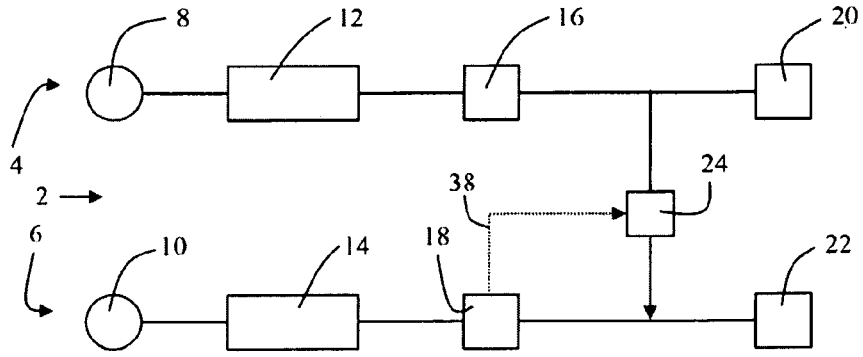

FIG. 6 shows essentially the same configuration as shown in FIG. 1.

Figure 7:
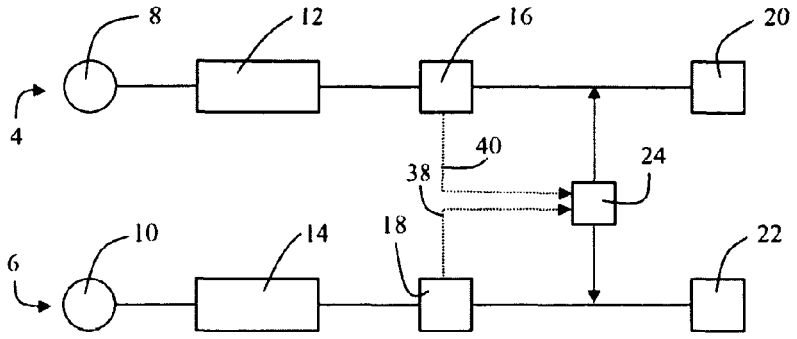
Figure 8A:
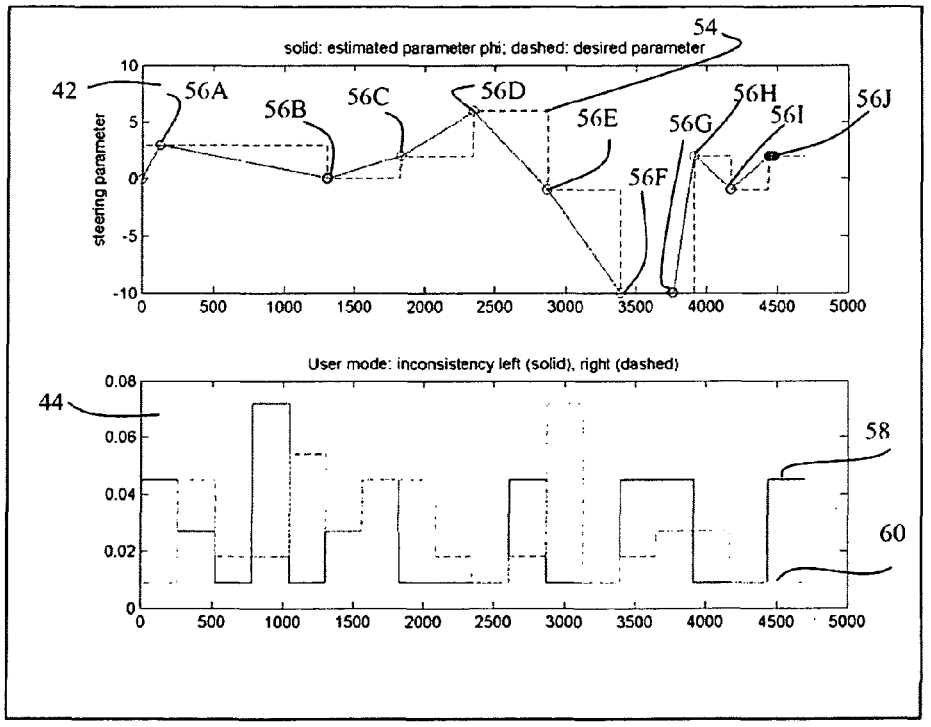
Figure 8B:
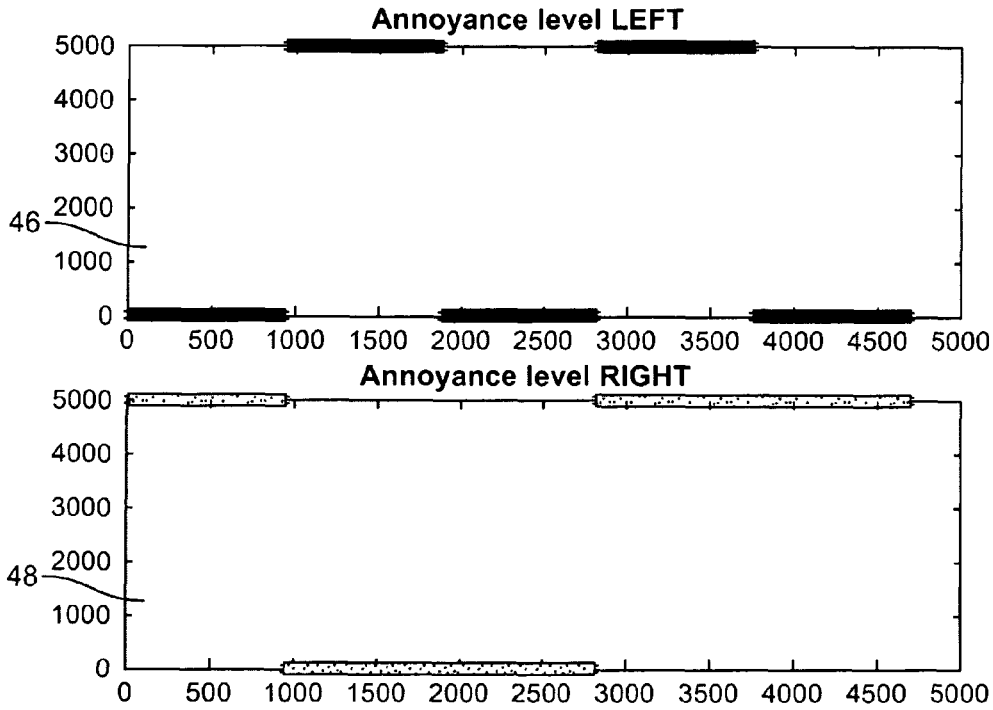
Figure 8C:
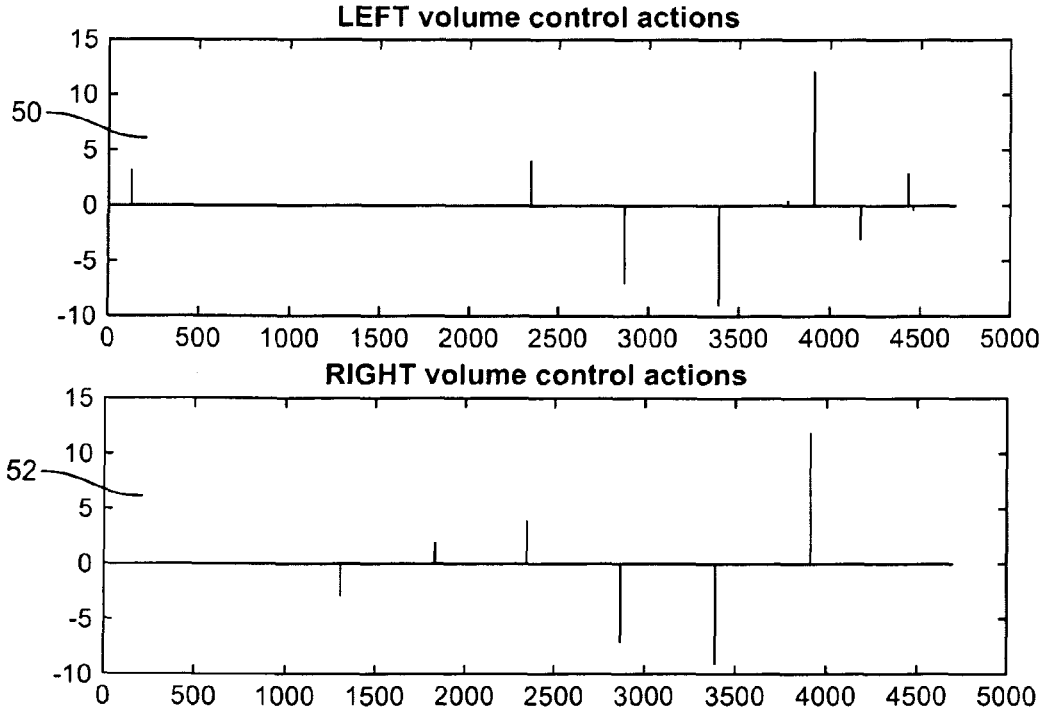
Figure 9:
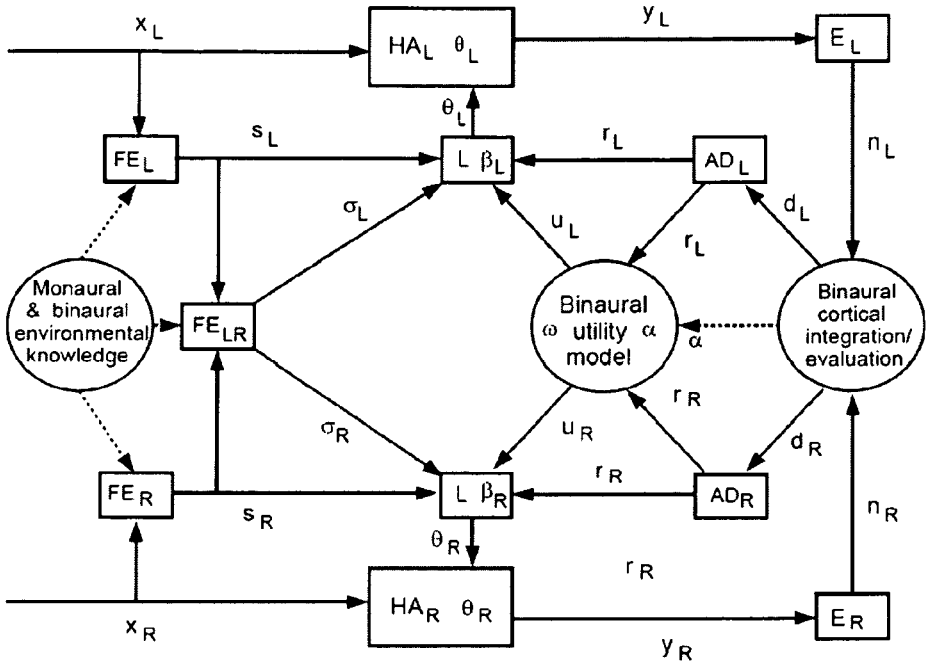
Figure 10:
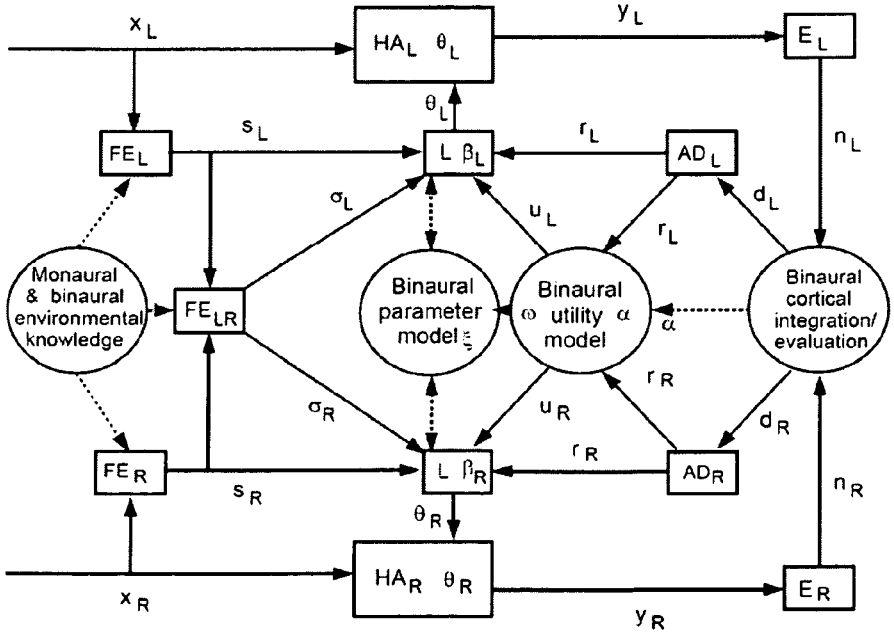
Figure 11:
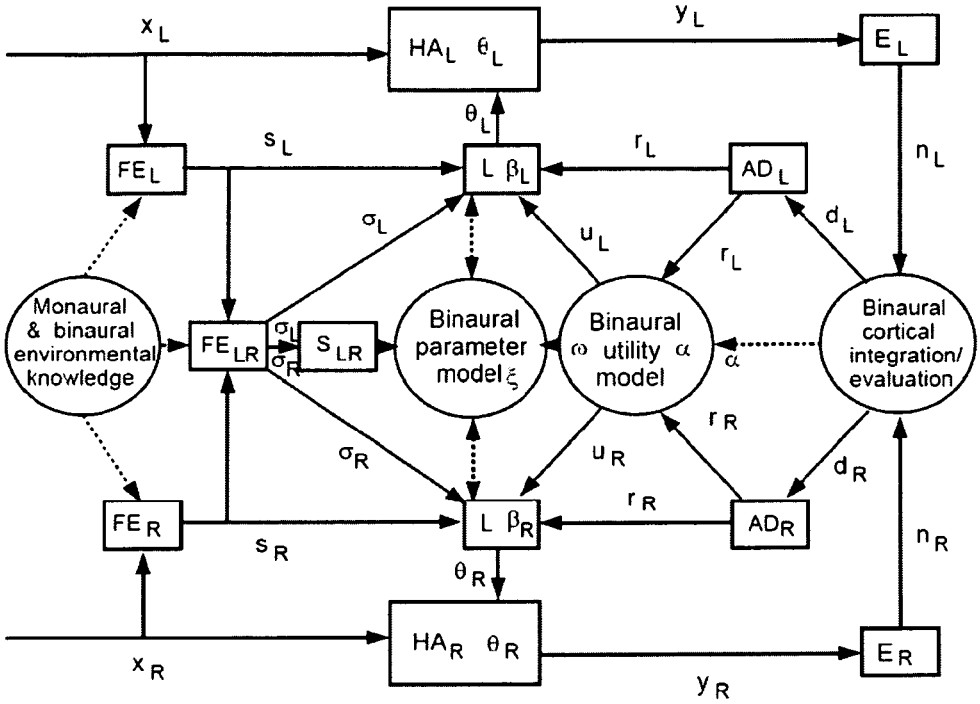
Figure 12:
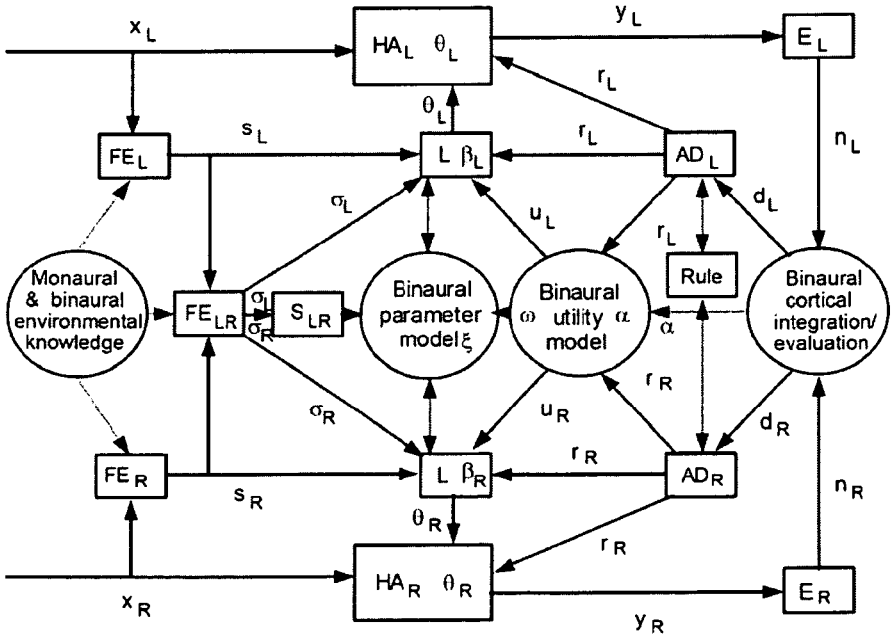
Figure 13:
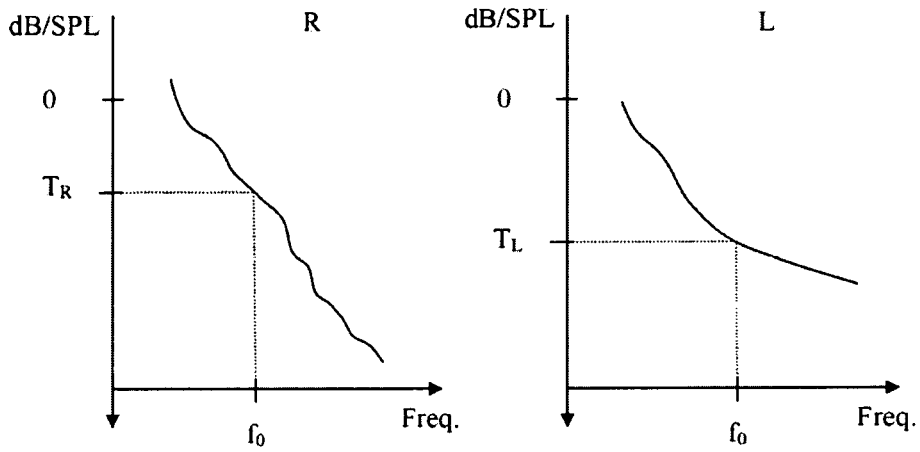
Figure 14:
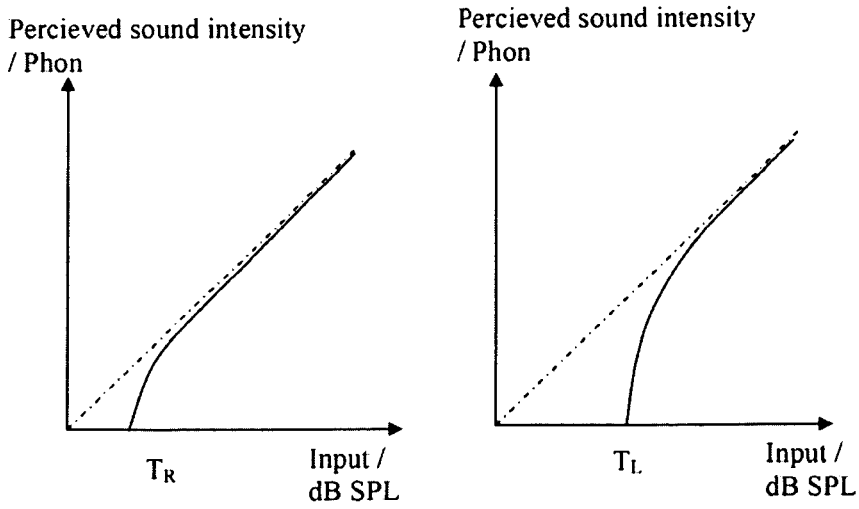

FIG. 7 shows an embodiment, wherein either one of the two hearing aids may assume the role of master device, FIGS. 8A, 8B and 8C are schematic illustrations of a simulation of the second embodiment, FIG. 9 is a schematic illustration of a third embodiment, FIG. 10 is a schematic illustration of a modified version of the third embodiment, FIG. 11 is a schematic illustration of a fourth embodiment, FIG. 12 is a schematic illustration of a sixth embodiment FIGS. 13 and 14 are schematic illustrations of hearing loss of a person.

DETAILED DESCRIPTION OF THE EMBODIMENTS

Various embodiments are described hereinafter with reference to the figures. It should be noted that elements of similar structures or functions are represented by like reference numerals throughout the figures. It should also be noted that the figures are only intended to facilitate the description of the embodiments. They are not intended as an exhaustive description of the invention or as a limitation on the scope of the invention. In addition, an illustrated embodiment needs not have all the aspects or advantages shown. An aspect, feature, or an advantage described in conjunction with a particular embodiment is not necessarily limited to that embodiment and can be practiced in any other embodiments even if not so illustrated.

FIG. 1 illustrates a simplistic block diagram of a binaural hearing aid 2. The binaural hearing aid 2 comprises two separate hearing aids 4 and 6 that are adapted or configured to communicate with each other. Each of the hearing aids 4, 6 are equipped with an input transducer 8, 10, e.g. a microphone and/or a telecoil (not shown), for the provision of an electrical input signal. The hearing aid 4, 6 also comprises an audio signal processor such as a compressor 12, 14, a volume control 16, 18, and an output transducer 20, 22 such as a receiver. The binaural hearing aid 2 in FIG. 1 is shown in a master slave configuration, wherein an adjustment of the volume control 16 on the master hearing aid 4 is followed by an automatic adjustment of the volume of the second hearing aid 6 in dependence of a model, indicated by processing block 24, of the hearing loss of the user. In this example the adjustment of a hearing aid processing parameter of the master hearing aid is an adjustment of volume, however, it is to be understood that it may be any other kind of hearing aid processing parameter, and the adjustment of one kind of processing parameter in the master hearing aid 4 is not necessarily followed by an adjustment of the same kind of hearing aid parameter (in this example also a volume adjustment in the slave hearing aid 6) in the slave hearing aid 6. Furthermore, it is to be understood that the adjustment of the processing parameter (in this example the volume) in the master hearing aid may be triggered automatically, e.g. by an automatic change of program in the master hearing aid. This automatic change of program may for example be triggered by a change in the ambient acoustic environment of the binaural hearing aid 2. The model processing block 24 may be incorporated in either one of the two hearing aids 4 or 6. It is understood that in this embodiment the volume control 18 of the slave hearing aid 6 is optional.

Figure 2:
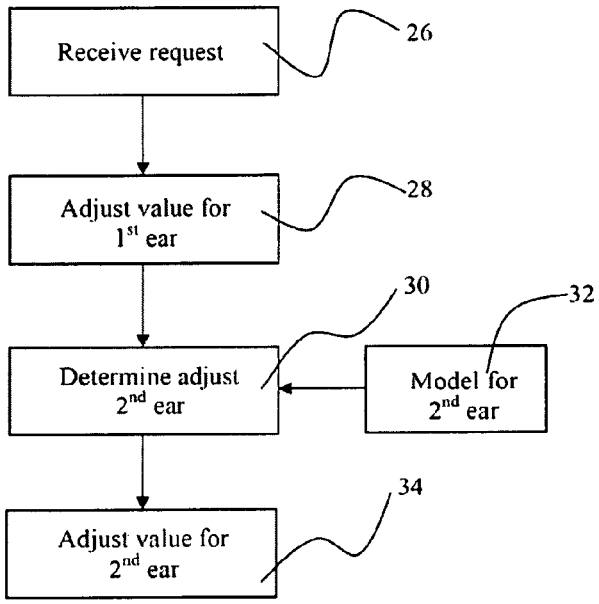

FIG. 2 is a schematic illustration of a flow diagram illustrating steps of a first embodiment.

The method relates to adapting, adjusting or changing signal parameters in a binaural hearing aid system. The binaural hearing aid system comprises two hearing aids, one for the left ear and one for the right ear of a wearer or user. In the present specification the two hearing aids are referred to as the first and the second hearing aid. The left and the right hearing aid may assume the role of the first and the second hearing aids in different situations. When one of the hearing aids is operated or receives a request to change a processing parameter this hearing aid is referred to as the first hearing aid, the other is then synchronized in an asymmetric manner. This other hearing aid is then referred to as the second hearing aid.

A request for change of a processing parameter is received 26. The request comprises an indication of which processing parameter to change. In certain embodiments the request may comprise indication of several parameters. In addition to the identification of the parameter, the request may comprise an indication of an amount of change of the parameter.

The request for change of a processing parameter may be generated by one of several devices or units. Usually one or both the hearing aids in a binaural hearing aid system comprise a volume wheel. This volume wheel may generate a request for change of a processing parameter. This request may be accompanied by an indication of the amount that the processing parameter should change.

The method further comprises adjusting 28 the signal processing parameter in the first hearing aid. In one embodiment, the processing parameter is changed or modified at the first hearing aid directly, i.e. without regards to hearing loss in the first ear.

The method also comprises determining 30 a processing parameter change for the second hearing aid based on the request for processing parameter change and a specific model 32 wherein the model represents hearing loss of the second ear of the user and/or preferred asymmetry in first and second ear according to the individual user's preferences.

This is contemplated to be advantageous as it is assumed that the user desires to change processing parameters in the first ear based on the user's perception of sounds at the first ear and therefore operates e.g. a volume wheel at the first ear.

In an embodiment, the method provides automatic change or adaptation of a processing parameter for the second ear based on the request for a parameter change for the first ear and a model for the hearing loss for the second ear. In a specific embodiment, the method provides automatic change or adaptation the same processing parameter for the second ear based on the request for the parameter change for the first ear and a model for the hearing loss for the second ear. The model for the second ear is preferably a frequency dependent model.

Examples of asymmetrical hearing loss include different loudness perception, i.e. different amount of recruitment or hyperacusis L-R (where L-R denotes left-right) resulting in one or more of different threshold level, different most comfortable level (MCL level), different uncomfortable levels (UCL levels) or during fitting a L-R level mapping could be selected or measured.

Also, asymmetrical SNR loss might impact the L-R mapping curve, e.g. with respect to comfort or intelligibility preference. This seems difficult to predict and points to experiments or measurements during fitting.

The method also comprises the step of changing or adapting one or more signal processing parameter in the second hearing aid. The calculation or determination of the signal processing parameter change for the first and/or second hearing aid may be performed in either hearing aid. In some embodiments of binaural hearing aids both hearing aids comprises signal processing units. The signal processing parameter may be set in one hearing aid and then transmitted to the other hearing aid. One example of this is a binaural hearing aid system where the two hearing aids are in communication via a wireless connection, such as Bluetooth or another suitable protocol. Alternatively the two hearing aids may be connected by an electrical conductor.

Figure 3:
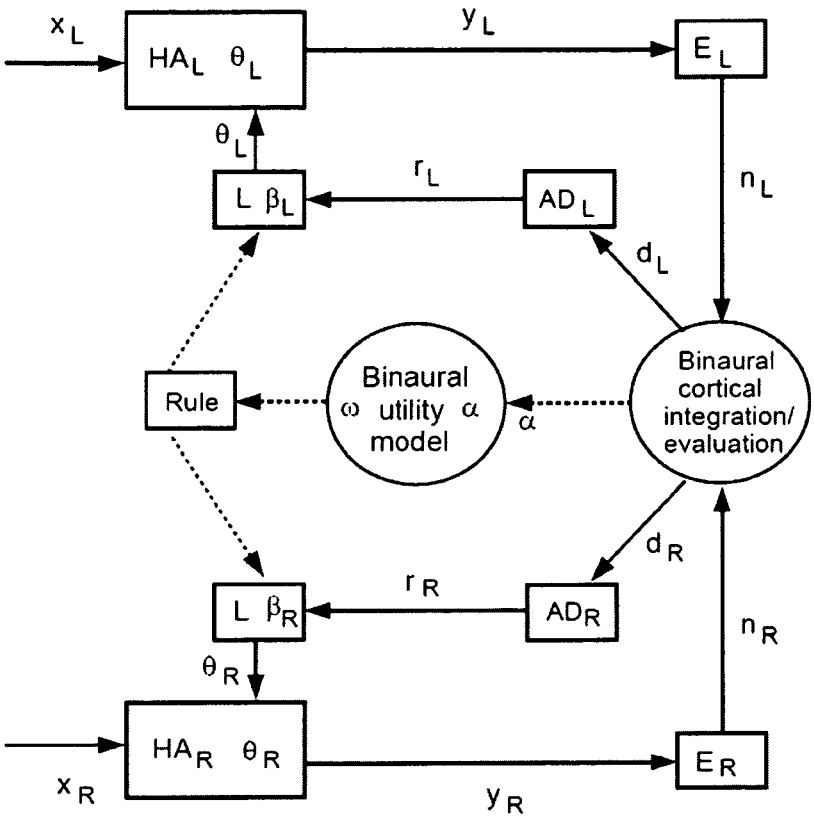
FIG. 3 is an alternative illustration of the first embodiment.

FIG. 3 illustrates an embodiment of a binaural hearing aid system, wherein the system uses asymmetric synchronization of left and right hearing aid parameters.

In an advantageous embodiment the model or transfer function between the two hearing aids of the binaural hearing aid system may provide a non-linear or asymmetric transfer function of changes made at one hearing aid to the other hearing aid.

Advantageously if the user controls only the first hearing aid, the second hearing aid may be synchronized, in an asymmetric manner, with the first. For the majority of listening situations, this may be perfectly acceptable for the user.

For example, if a user operates the volume wheel of one of the hearing aids in a binaural hearing aid system and has audibility ranges that are different for the left ear and the right ear, volume change for the second hearing aid may be different from the volume change in the first hearing aid leading to the same perceived increase or decrease in loudness for both ears. In such cases, embodiments of the system described herein allows automatic adjustment of the second hearing aid based on the operation performed on the volume wheel, and a model representing the difference in audibility ranges for the user. Thus, the user does not need to individually adjust each of the two hearing aids.

In some embodiments the system may be configured for computing the magnitude of the overall gain change, due to the volume adjustment, in the first ear relative to the audibility range in the first ear and then issuing a gain change in the second ear that has the same magnitude relative to the audibility range in the second ear.

Throughout FIGS. 3 to 12 subscripts L and R refer to left and right, respectively. In FIG. 3 left and right incoming sound, denoted with x, is processed by hearing aids HA that output processed sound y.

This output sound y is input to the left and right ear E, transformed into left and right auditory nerve signals n, which are combined in the brain, where it is observed, integrated, and evaluated. Based on such a binaural integration and evaluation of the processed left and right sound, a user may make a decision d to adjust left and/or right hearing aids.

This will lead to an adjustment, which will constitute a correction r to be issued in some way to the hearing aid(s).

The learning modules L learn and apply a mapping from user corrections r via a prescribed rule. In the case that a correction or adjustment r is issued at only one of the instruments in the binaural hearing aid system, the rule computes the optimal hearing aid processing parameter θ in the adjusted instrument and at the other instrument given a binaural utility model $\underline{U}$. In the simplest case, such a utility model passes information about the left and right hearing loss $HL_L$ and $HL_R$ of the patient to the model or rule. In general, the utility model may include an auditory profile α that includes information regarding left and/or right hearing loss and may also include other parameters that reflect aspects of the user's hearing loss, sound appreciation and/or life style. A utility model may also include utility parameters ω. The learning modules may contain parameters β that govern the mapping from adjustments to parameters. In this first embodiment, the rule governs the computation of left and right processing parameters in the learning modules, indicated by the arrows from Rule to Learning modules. Choices for the fixed mapping f(.) are represented by some setting of the parameters β, governed by the rule. In other embodiments the mapping may not be fixed and may be variable.

The behavior may be modeled for this example with update equations $$\begin{bmatrix} \theta_k^L \\ \theta_k^R \end{bmatrix} = \begin{bmatrix} \theta_{k-1}^L \\ \theta_{k-1}^R \end{bmatrix} + \begin{bmatrix} r_k^L \\ f(r_k^L; HL_L, HL_R) \end{bmatrix} \tag{1}$$

where the outputs $\theta_k^L$ and $\theta_k^R$ are the parameter (column) vectors of the left and right hearing aid at consent time k, $\theta_{k-1}^L$ and $\theta_{k-1}^R$ are the previous values of the left and right hearing aid parameter vector and $r_k^L$ is the user correction vector to the left hearing aid at time k. Furthermore, $f(r_k^L, HL_L, HL_R)$ is some (possibly nonlinear) scaling of the left hearing aid user correction vector that is applied to the right ear, and takes into account the hearing loss in both ears. In practice, the hearing aid parameter vectors are typically one-dimensional, but when a suitable user correction vector $r_k^L$ with more than one dimension can be supplied by the user, a multi-dimensional parameter vector can also be synchronized asymmetrically.

In this embodiment time stamp t is defined as the ongoing time, measured e.g. in multiples of the sampling period 1/Fs, where Fs is the sampling frequency of the digital hearing aid processor.

Also consent time k is defined as the time stamp $t_k$ at which an explicit consent was given by the user to a certain adjustment. The user operates a control function (a wheel, a push button, a remote control, or some other user control interface) in order to influence the sound processing function of the hearing aid. The time at which the user releases the user control (and leaves it unchanged for a certain amount of time) is called a consent moment. Consent moment k refers to the k-th time that the control is released (and left unchanged). In some embodiments when performing asymmetric synchronization of user adjustments to a control, the system is configured to act at consent moments. The left and right hearing aid parameter vectors at consent time k from equation (1) are applied inside the hearing aid system as new processing parameters any time between the current consent moment k and the next consent moment k+1, i.e. updated $\theta_k^L$ and $\theta_k^R$ are used as $\theta_t^R$ and $\theta_t^R$ at time stamps between $t_k$ and $t_{k+1}$. Similar rules are used for converting updated steering parameters at consent times to arbitrary time stamps during on-line processing of incoming sound.

In one embodiment one may choose the nonlinear scaling function as $$f(r_k^L, HL_L, HL_R) = \text{scaleback}(\text{scale}(r_k^L; HL_L); HL_R)$$

where the scale(.) function scales the adjustment in the left hearing aid according to the left hearing loss, and the scaleback(.) function uses this 'perceptually scaled adjustment' to compute the adjustment according to the right hearing loss. The right hearing aid parameter is thus synchronized with the left, but using a modified left hearing aid correction, allowing for asymmetry between the hearing aids. Further, only one correction issued to the left hearing aid is used to correct both hearing aids, which avoids operating two controls, which is contemplated to be a benefit to the user.

An alternative implementation or embodiment could make use of the update equations $$\begin{bmatrix} \theta_k^L \\ \theta_k^R \end{bmatrix} = \begin{bmatrix} \beta_k^L \\ f(\beta_k^R, r_k^L : HL_L, HL_R) \end{bmatrix} + \begin{bmatrix} r_k^L \\ r_k^R \end{bmatrix} \tag{2}$$

The nonlinear scaling again applies the left hearing aid correction such that the perceived change in the left hearing aid is similar to the perceived change in the right hearing aid. However apart from hearing loss in both ears now the function also takes into account the previous value of the right hearing aid parameter vector. The additional user correction in the right hearing aid $r_t^R$ will usually be zero, but the user is allowed to perform an additional fine tuning at the right hearing aid, if needed. In some embodiments the additional user correction may be learned by or absorbed in the model representing the hearing loss in an ear thereby improving future adjustments based on the model.

Note that in the above examples the left hearing aid plays the role of the first hearing aid, but the roles may be exchanged. For example in other embodiments the right hearing aid may play the role of the first hearing aid.

In other embodiments, different controls for expressing parameter adjustments and different models to compute the best modified change in the other ear from the adjustment in the first ear and the hearing loss in both ears are also contemplated.

The flow diagram presented in FIGS. 2 and 3 relate to the above embodiments.

Figure 4:
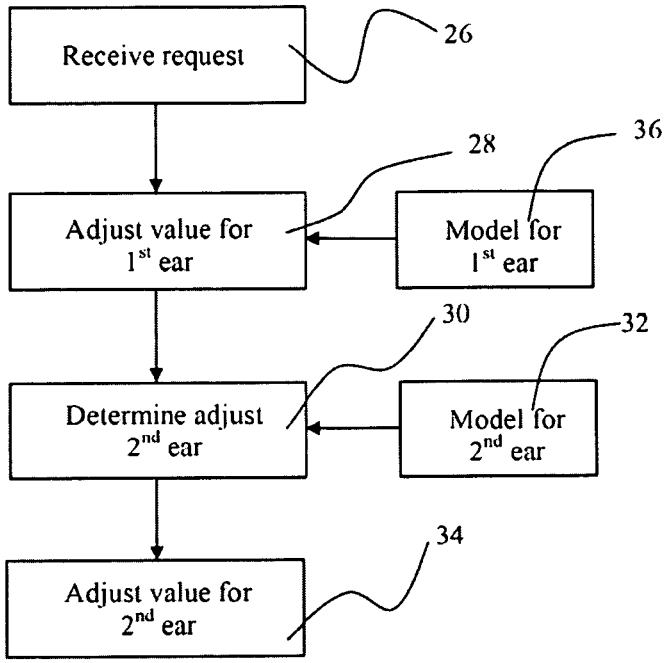
FIG. 4 is a schematic illustration of a modified first embodiment of the method.

FIG. 4 is a schematic illustration of a modified first embodiment of the method. FIG. 4 comprises similar steps as in FIG. 2, similar steps has been numbered with similar reference numerals.

In addition to the steps in FIG. 2, the method illustrated in FIG. 4 includes the box 20. This is to indicate the use of a hearing loss model of the first ear when performing or calculating the adjustment of the processing parameter or processing parameters for the first hearing aid.

A second embodiment provides synchronizing left and right steering parameters using asymmetric user feedback and asymmetric acoustic features. This second embodiment is illustrated in FIG. 5.

The idea of asymmetric synchronization may be extended by introducing left and right hearing aid sound feature (row) vectors $s_t^L$ and $s_t^R$. These vectors will steer the parameters of both hearing aids via a set of weighting coefficients, or steering parameters, $\beta$, that are shared between both hearing aids, e.g. using the mapping $$\begin{bmatrix} \theta_k^L \\ \theta_k^R \end{bmatrix} = \begin{bmatrix} S_k^L \\ S_k^R \end{bmatrix} \beta + \begin{bmatrix} r_k^L \\ r_k^R \end{bmatrix} \tag{3}$$

This system of equations expresses that the left and right (scalar) hearing aid processing parameters are changing with the acoustic environment (as represented by left and right sound feature vectors $S_t^L$ and $S_t^R$) using a shared steering vector $\phi$. Further, user adjustments $r_t^L$ and $r_t^R$ are added to the environmentally steered parts $S_t^L\phi$ and $S_t^R\phi$. In this embodiment we will consider scalar hearing aid parameter vectors $\theta_k^L$ and $\theta_k^R$ but this does not limit the application of the ideas behind the embodiment to the one-dimensional case, because in an alternative embodiment, asymmetric synchronization of multidimensional parameter vectors could be used as well.

Note that we do not specify how user adjustments $r_t^L$ and $r_t^R$ change with time. E.g. as a result of a learning step $\Delta_k^L$ on the basis of an adjustment to the left aid at consent time k, we may discount the adjustment as $r_\tau^L - \Delta_k^L$ at time stamp $\tau$ at which the learning step is applied. We may leave the adjustment unchanged otherwise (hence the only way that the adjustment is modified is by user interaction).

One component in each of the sound feature vectors may be set to 1, hereby providing an environment-independent bias. The user is allowed to operate either of the hearing aids, or both of them, which will result in either a left user correction $r_t^L$, a right user correction $r_t^R$ or a combination of left and right user correction. The shared steering vector $\beta$ may e.g. be predefined by using prior knowledge about hearing loss, user preferences, etc.

Additionally, an on-line learning method may be designed that incorporates the user corrections and updates the common weighting vector. In the present context the term on-line is construed as meaning during usage of the hearing instrument, as opposed to off-line, i.e. during a fitting session at a dispenser's office or the like. Hence, the binaural hearing aid system is synchronized at the level of the steering parameters, but the actual hearing aid parameters that result from this steering may differ between the ears when the features differ and/or when the user corrections differ between the ears. More specifically, it is proposed to use a linear Gaussian model for the hearing aid parameters, also called 'the output model', as $$\begin{bmatrix} \theta_k^L \\ \theta_k^R \end{bmatrix} = \begin{bmatrix} S_k^L \\ S_k^R \end{bmatrix} \beta_k + \begin{bmatrix} \varepsilon_k^L \\ \varepsilon_k^R \end{bmatrix} \tag{4}$$

where the $\epsilon_k^L$ and $\epsilon_k^R$ are zero mean Gaussian noise sources with variance $\Sigma_k^L$ and $\Sigma_k^R$ respectively, which represent the noise in the user adjustments at consent time k. Note that in the model, the $\phi_k$ term is a stochastic variable that represents the current steering vector, which is used to estimate/update the shared steering vector $\phi$ that is applied in the hearing aid processing.

We model asymmetric adjustment errors and intrinsic user inconsistencies with noise sources, which are Gaussian stochastic variables with, possibly, different mean and covariance matrix. Further, $\theta_k^L$, $\theta_k^R$ and $\phi_k$ are time-varying stochastic variables, where we take $\theta_k^L$, $\theta_k^R$ as scalars and $\phi_k$ as vector. As mentioned before extensions to include multidimensional $\theta_k^L$, $\theta_k^R$ can be made according to an alternative embodiment.

A binaural moment of explicit consent k now refers to a certain 'synchronization time window' starting at time stamp $t_k$. Here a user releases the control at either or both of the hearing aids to modify the hearing aid parameter and then leaves the released control value(s) untouched for a certain period of time. During such a binaural consent moment (referred to hereafter as just 'consent moment'), the desired hearing aid parameter values are at least partly known, and the acoustic features may always retrieved in both hearing aids of the hearing aid system. To model changing user preferences, we assume e.g. that an evolution of the parameters, i.e. 'the state model', may be modeled as e.g.

$$\phi_k=\phi_{k-1}+\xi_k \tag{5}$$

where $\xi_k$ is zero-mean Gaussian noise with covariance matrix $\Gamma_k$ that represents uncertainty in the evolution of the state (i.e. steering) variables $\phi_k$. At each consent moment we may now update the steering parameters by computing the posterior mean of the state variables e.g. by using the Kalman filter update formulas. Other appropriate formulas may also be used. E.g. special cases of this model are updates obtained with recursive least-squares or normalized least-mean-squares. When corrections to both hearing aids have been issued during the synchronization time window, the 'binaural output vector'

$$\underline{\theta}_k = \begin{bmatrix} \theta_k^L \\ \theta_k^R \end{bmatrix}$$

is fully observed along with the 'binaural acoustic feature vector'

$$\underline{s}_k = \begin{bmatrix} s_k^L \\ s_k^R \end{bmatrix},$$

and standard update formulas may be used. Under for example a Bayesian framework we may derive the following:

We define the binaural noise vector $$\underline{\varepsilon}_k = \begin{bmatrix} \varepsilon_k^L \\ \varepsilon_k^R \end{bmatrix}$$

which is distributed according to a normal distribution with zero mean and covariance matrix $$\Sigma_k = \begin{bmatrix} \Sigma_k^L & 0 \\ 0 & \Sigma_k^R \end{bmatrix}.$$

When output vectors and acoustic features at both hearing aids are fully observed, the output model equation (4) may be rewritten as $$\underline{\theta}_k=\underline{s}_k\phi_k+\epsilon_k \tag{6}$$

which in combination with state model equation (5) gives rise to the following Kalman filter update equations:

$$\begin{aligned}
\Sigma_{k|k-1}^{\phi} &= \Sigma_{k-1}^{\phi} + \Gamma_k \\
K_k &= \Sigma_{k|k-1}^{\phi} s_k^T (s\Sigma_{k|k-1}^{\phi} s_k^T + \Sigma_k)^{-1} \\
\hat{\phi}_k &= \hat{\phi}_{k-1} + K_k(\underline{\theta}_k - s_k\hat{\phi}_{k-1}) \\
\Sigma_k^{\phi} &= (I - K_k s_k)\Sigma_{k|k-1}^{\phi}
\end{aligned}$$

where we effectively make recursive estimates of the posterior probability of the (shared) binaural steering vector, $$p(\phi_k \mid \underline{\theta}_1, \ldots, \underline{\theta}_k) = N(\hat{\phi}_k, \Sigma_k^{\phi})$$

With $N(\mu,\Sigma)$ we denote a normal distribution with mean $\mu$ and covariance matrix $\Sigma$ When only one of the corrections is present, the output vector is only partially observed, i.e. the entries corresponding to the desired parameters of the other hearing aid are not observed. We may learn from such 'partial evidence' by integrating out the hidden part of the output vector. The update equations follow the Kalman filter update equations, but when we have partial evidence we may integrate over the hidden part of the output vector, leading to slightly different update equations. For example, when we only observe a user action $\theta_k^R$ to the right instrument of the binaural hearing aid system, we will make a recursive estimate of the posterior $p(\phi_k|\underline{\theta}_1, \ldots, \underline{\theta}_k)$ using only the right instrument user action:

$$\begin{aligned}
\Sigma_{k|k-1}^{\phi} &= \Sigma_{k-1}^{\phi} + \Gamma_k \\
K_k &= \Sigma_{k|k-1}^{\phi} s_k^{RT} (s_k^R \Sigma_{k|k-1}^{\phi} s_k^{RT} + \Sigma_k^R)^{-1} \\
\hat{\phi}_k &= \hat{\phi}_{k-1} + K_k(\theta_k^R - s_k^R\hat{\phi}_{k-1}) \\
\Sigma_k^{\phi} &= (I - K_k s_k^R)\Sigma_{k|k-1}^{\phi}
\end{aligned}$$

When only a user action on the left instrument is observed, the same equations hold, but with the R superscript replaced by a superscript L. With $S_k^{RT}$ we denote the transposed of the acoustic feature vector at consent time k at the right instrument, i.e. the transposed of $S_k^R$.

Since we have different variance terms $$\Sigma_k^L \text{ and } \Sigma_k^R$$

for the left and right user actions, on-line tracking of these terms may lead to different estimates for the consistency in the left and right user actions. An asymmetry in the left and right consistency based on prior expectations (e.g. when the subject is left-handed, he may experience less inconsistency in his left actions) can be put in e.g. as an asymmetry in the initial values $$\Sigma_0^L \text{ and } \Sigma_0^R.$$

Special cases of this model are updates obtained with recursive least-squares or normalized least-mean-squares, which are implemented readily by a person skilled in the art based on this disclosure.

From the above, it can be noticed that one can make recursive estimates of the posterior over the steering parameters based on either a left, a right or a joint left-right adjustment at a certain consent moment. Hence, we synchronize the left and right instruments of the binaural hearing aid system on the level of the shared steering parameters, but allow for asymmetry in the adjustments or asymmetric consistency of adjustments.

A flow diagram of this further embodiment is presented in FIG. 5.

In addition to FIG. 2, the possibly noisy adjustment(s) are considered as a joint left-right adjustment to the hearing aid system and will be applied to both hearing aids by taking the noise in left and/or right adjustments into account. Furthermore, the learning and steering modules L learn and apply a mapping from sound feature vectors s to hearing aid parameters $\theta$. A particular kind of sound feature is the identity feature, in which case the parameter learning and steering is effectively training and applying a personalized value for the hearing aid parameter vector. The environmental sound features are extracted by a feature extraction unit FE per hearing aid, based on monaural environmental knowledge. These features may be combined and adapted for each hearing aid using binaural environmental knowledge in a binaural feature extraction unit $FE_{LR}$, which then leads to 'binaurally optimized' monaural feature vectors $\sigma$. Examples of relevant acoustic features are: RMS value of input, probability of speech, signal-to-noise ratio, signal-to-noise-ratio weighted by the band-importance function for speech, environmental classifier output, etc.

Incorporating the user adjustment(s) in the hearing aid system is visualized in FIG. 5 as the two arrows containing an adjustment r from the adjustment box AD. An initial asymmetry is put into the system by estimates of the prior inconsistency in left and right user adjustments $\Sigma_0$ using the binaural utility model $\underline{U}$. Since this is prior information rather than an on-going flow of information, the arrows from utility model to Learning modules are dotted. However, these initial estimates influence the mapping of adjustments to processing parameters, via parameter learning and steering modules L, which are sharing a common (synchronized) steering vector $\beta$.

The following relates to a simulation of the second embodiment, and is illustrated in FIGS. 8A, 8B and 8C.

In the simulation, a piece of music is digitized, processed by an artificial hearing aid and played to an artificial user. Based on a model for the desired steering coefficients, and assuming that the artificial user has access to the same sound features as the artificial hearing aid, the user will issue corrections to either left, right or both hearing aids if the annoyance threshold for the corresponding ear is exceeded.

The annoyance threshold is predefined for each ear, and may be different for each ear. A current amount of annoyance is determined on the basis of the difference between desired and currently realized steering coefficients in either ear. Further, the amount of user inconsistency, i.e. the noise added to the ideal correction(s) when they are issued, may be different for each ear, hence simulating asymmetric dexterities. Finally, the acoustic feature values may be (very) different in each ear, hence simulating different sound fields in both ears, giving rise to different left and right feature values.

FIGS. 8A, 8B and 8C schematically illustrate learning common steering coefficients from asymmetric user inputs and asymmetric acoustic features The simulation result will now be discussed by referring to each of the FIGS. 8A, 8B and 8C with their row number as indicated in the FIGS. 8A-8C, the row with reference numeral 42 being the first subfigure and the row with reference numeral 52 being the last subfigure. In all of the rows, the horizontal axis denotes sample number, in other words: time.

Each sample corresponds to a sample of the music signal that is played to the artificial user. During playing, the desired (common) steering parameter $\alpha_t$, which is a scalar. A one-dimensional feature vector for each of the hearing aids is assumed for simplicity. In FIG. 8A the parameter varies according to the line 54. It is seen that the estimated value $\beta_t$ (referred to in the caption of the subfigure as theta) 'tracks' the values of the desired parameter $\alpha_t$ very well, in only a few updates.

Each plotted circle 56A-56J denotes one update step, and after each transition of $\alpha_t$ a few updates, shown by a few almost overlapping circles at each transition, suffices to adapt to the new desired value.

In the second row 44 the noise in the user corrections changes with time and is also very different per ear, a high value denotes high correction noise or Inconsistency, solid line 58 is left ear, dotted line 60 is right ear. In the middle two rows 46, 48 the annoyance thresholds for both ears is shown, high values denote high thresholds.

When playing the music, we start with a segment with a low annoyance threshold in the left ear, i.e. annoyance with already small deviations from desired steering parameter value. The annoyance threshold for the right ear is quite high, so user corrections to the right hearing aid will only be issued with very large deviations or variations of the steering parameter. The annoyance thresholds are then reversed in the second segment, so corrections to the right hearing aid will be issued more easily than corrections to the left hearing aid, low for both ears in the third segment, high for both ears in the fourth segment, and finally equal again to the first segment.

Now we may see which user corrections have given rise to the tracking behavior shown in the first row. The first transition in the desired steering parameter $\alpha_t$ is learned from a few user corrections issued in the left hearing aid, around time sample 130, shown as the small peak 62 in row 50, which denotes a set of noisy corrections issued to the left hearing aid. During the time samples around sample 130, there are no corrections issued to the right hearing aid, which may be seen from the graph of the right user corrections which is flat at zero during these time samples.

The transition around time sample 1300 in row 52 on the other hand is tracked from the user corrections issued to the right hearing aid. Recall that the annoyance threshold for the right ear in this section is now low, so corrections to the right hearing aid will be issued more easily than corrections to the left hearing aid. The same is true for the transition around time sample 1800.

During the third segment, the transition around time sample 2400 is tracked by user corrections in both hearing aids. The following three transitions are so large that all of them exceed the threshold of both ears, and corrections are issued in both ears as well. Finally, the more subtle transitions in the fifth segment are only causing annoyance in the left ear and the tracking is done on the basis of the left user corrections.

What is not seen from this figure is the asymmetry between the features over the hearing aids, i.e. the same feature extraction procedure was applied to the music signal for both hearing aids, but the feature values in the left hearing aid were distorted with quite some noise and then taken as the right hearing aid feature values.

From the above described simulation it becomes clear that a common steering parameter vector may be tracked using full or partial evidence from left and right user corrections with different inconsistencies, and using different feature values in both ears. Hence, user feedback may be issued asymmetrically in the hearing aids, and the symmetry in the hearing aid parameter steering will depend on the symmetry in the acoustic fields in the ears. Further it depends on the symmetry in the extracted acoustic features. Since the hearing aids share a common steering vector, similar acoustic fields give rise to similar steered hearing aid parameter vectors, and vice versa.

The learning procedure may deal with full and/or partial evidence, and since the user inconsistency may be tracked in each of the hearing aids and the step size of the learning rule is inversely proportional to the estimated user inconsistency, feedback from the 'more consistent ear' will give larger contributions to the tracking than the feedback from the 'more noisy ear', which is preferred. Therefore, the above described embodiment is a truly asymmetric mechanism for hearing aid synchronization.

The following describe a third embodiment that uses the idea of synchronization at the level of the steering parameters $\beta_t^L$ and $\beta_t^R$, rather than at the level of the hearing aid parameters $\theta_t^L$ and $\theta_t^R$. The third embodiment is illustrated in FIG. 9.

However, in this third embodiment the synchronization will occur at the level of hyperparameters of the steering parameters, in order to allow for asymmetric steering parameters as well. In other words, one could synchronize the parameters that control the distribution over left and right steering parameters, rather than synchronize the steering parameters themselves.

The left and right steering parameters are coupled via a common probability model, which includes left and right hearing loss, but possibly also a user preference function. The rationale is that the user will perceive the hearing aid parameter settings as more preferable if they are synchronized after taking into account the 'natural asymmetry' in the overall hearing aid system. This will partly depend on the asymmetry in the hearing loss, but may also be subject to considerations like asymmetric fitting of hearing aids for allowing more central (cerebral) processing of left and right hearing aid outputs.

Hence this embodiment provides a method using knowledge of prior asymmetric distribution on the steering parameters by using the asymmetry in the hearing loss and heuristics from approaches to asymmetric fitting. Without additional user corrections, this prior distribution will dictate the binaural steering; additional, possibly asymmetric, user corrections are used to update the common probability model over the steering parameters using a Bayesian framework, leading to, on-line updated, posterior means over the steering parameters $\beta_t^L$ and $\beta_t^R$.

More specifically, the following factorized output model is assumed $$\begin{bmatrix} \theta_k^L \\ \theta_k^R \end{bmatrix} = \begin{bmatrix} s_k^L & 0 \\ 0 & s_k^R \end{bmatrix} \begin{bmatrix} \beta_k^L \\ \beta_k^R \end{bmatrix} + \begin{bmatrix} \varepsilon_k^L \\ \varepsilon_k^R \end{bmatrix} \tag{6}$$

where the acoustic feature vectors may contain a 'constant' feature component, to account for a left bias and/or a right bias, and hearing aid parameters $\theta_t^L$ and $\theta_t^R$ and steering parameters $\beta_t^L$ and $\beta_t^R$ are again stochastic variables. Left and right output noise $\epsilon_t^L$ and $\epsilon_t^R$, which model user inconsistency, is again modeled as Gaussian stochastic variables with possibly different mean and covariance matrix. are again considered to be stochastic variables, on the left and right hearing aids are conditionally dependent on 'prior asymmetry knowledge', represented by a distribution $$p\left(\begin{bmatrix} \phi_k^L \\ \phi_k^R \end{bmatrix} \middle| \underline{U}(\omega, \alpha)\right)$$

The prior asymmetry knowledge is represented with a 'binaural utility function' $\underline{U}(\omega, \alpha)$ that may incorporate some asymmetric fitting methodology represented by the left and right utility parameters $\omega$ and/or by some model of the preferred asymmetry (a user preference model) represented by the 'user asymmetry parameters' $\alpha$. Note that left and right hearing loss will be part of the user asymmetry parameters.

Using Bayesian techniques it is e.g. possible to compute most likely or maximum a posteriori steering parameters given such a binaural asymmetry model and 'observations' a about the user's hearing loss, life style, further auditory profile, etc. Further, Bayesian techniques allow for updating the prior binaural asymmetry model when (possibly asymmetric) user adjustments are applied to the binaural hearing aid system, and modified posterior means of the steering parameters may be used for on-line environmental steering.

Note that by using a common utility model for both hearings aids in a binaural hearing aid system, the left and right steering parameters $\phi_t^L$ and $\phi_t^R$ are not free to move, but restricted in a soft way to be similar to some degree. As a limiting case, one could even put direct (hard) constraints on difference that is allowed in the left and right steering parameters. More 'restrictive' binaural utility models will encourage more synchronized steering parameters, and vice versa. Learning actions take place as a result of adjustments applied to one or both hearing aids. Via an update (learning action) in the utility model as a result of these adjustments and/or via adapting the restriction on left and right steering parameters, this may lead to updated left and right steering parameters and hence parameters in both hearing aids.

A flow diagram of the above described embodiment is presented in FIG. 9. One difference compared to FIG. 5 is in the solid arrows from utility model to Learning modules. These arrows represent an ongoing flow of information about the current (left and right) utility of the experienced sound y. Another difference is that the solid arrows from the AD unit that represent ongoing flow of user adjustments r are now fed to the binaural utility model rather than to the Learning modules. It may be seen that the Learning modules are now updated on the basis of left and right utilities rather than left and right adjustments.

For example, if an adjustment r is made to one of the hearing aids, the amount of preferred asymmetry in the binaural utility model may be updated based on the new observation. From the updated utility values u, left and right steering parameters are modified as well.

In variations of the third embodiment, the utilities u are combined using some way of restricting the left and right steering parameters, i.e. a binaural parameter model, that is in turn parameterized by a vector $\xi$. A flow diagram of this modified version of the third embodiment is now presented and illustrated in FIG. 10.

In addition to FIG. 9, we now put direct restrictions on the left and right steering parameters via a binaural parameter model. The nature of the restriction (allowing for considerable asymmetry or perhaps fully synchronizing the steering parameters) is modified under influence of (modified) utilities u (the solid arrow from binaural utility model to binaural parameter model). Furthermore, the restriction due to the binaural parameter may influence both Learning modules L, denoted by the bidirectional (dotted) arrows from Learning modules to binaural parameter model.

A fourth embodiment describes a master-slave configuration.

FIG. 6 shows essentially the same configuration as shown in FIG. 1. However, in this embodiment the model 24 is updated due to a change in a signal processing parameter at the second hearing aid after a change in a signal processing parameter at the first hearing aid have caused an automatic update of the signal processing parameter at the second hearing aid.

As before the hearing aid 4 is the master, and hearing aid 6 is the slave. Like before, an adjustment of the volume control 16 is followed by an adjustment of the volume of the hearing aid 6 according to the model 24. However, if the user is not satisfied with this adjustment and corrects it by a subsequent adjustment of the volume control 18, then this active indication of dissent with the adjustment suggested by the model 24 may be used to update the model 24. This is indicated with the dashed arrow 38. Preferably, the adjustment of volume control 18 is only incorporated into the model 24, if it is performed in a short predefined time interval after the adjustment of the volume control 16, because otherwise it is probably not occasioned by the first adjustment of the volume control 16, but more probably occasioned by a change in the acoustic environment.

FIG. 7 schematically illustrates a configuration, wherein either one of the two hearing aids in a binaural hearing aid system may function as a master.

The update or modification of the model as illustrated in FIGS. 6 and 7 may be influenced by the ambient sound environment. The binaural hearing aid system may detect which type of ambient sound environment the user is in at any given time. If, e.g. noisy conditions are detected, the users desire to change the signal processing parameters could be influenced by the ambient sound environment. The model and/or the signal processing parameters may be changed automatically in response to a change in the ambient sound environment.

At each instance that the user or wearer changes a signal processing parameter, the model for either ear may be adapted or modified. This is illustrated in FIG. 7 by the dashed arrows 38 and 40.

A fifth embodiment relates to switching between different synchronization modes in addition to the embodiments one to four.

In addition to the above discussed features of the embodiments one to four, the embodiments may also comprise a discrete 'synchronization mode' variable, that controls the 'overall amount of asymmetry' in the binaural hearing aid system.

As an example, a 'high' value of the synchronization mode variable will constrain the steering parameters to be very similar, 'medium' and 'low' values will allow more deviations and finally 'off' will not synchronize the adjustments among the ears. The latter may e.g. be beneficial when picking up the phone (where the binaural hearing aid system should e.g. behave in an asynchronous mode). The value of the synchronization mode variable may be input by the user (e.g. by pressing a push button), but may also be tracked on-line. The above learning mechanisms should then be extended to incorporate a discrete mode switching variable this may for example be obtained by adopting switching Kalman filters for tracking the mode variable and the steering variables simultaneously. In FIG. 12, the synchronization mode switch is present as an asymmetry mode switch variable S that acts on 'binaurally optimized' monaural feature vectors σ. However, note that also the user may influence the mode switch directly (using e.g. a push button or a remote control). The arrow from the Binaural integration unit to the mode switch unit is omitted to enhance the readbility of the figure.

In an alternative example a value of the switch variable S is set to 'small', which could be implemented by letting the left and right steering parameters only differ by a small amount according to some distance measure. The allowable amount is not made dependent on the binaural utility values μ.

A sixth embodiment comprises all features of the first to fifth embodiments and further comprises asymmetric synchronization of an arbitrary meta-parameter vector. A meta-parameter is any parameter that influences the hearing aid parameters that are used to process the sound. E.g. an 'aggressiveness of learning' parameter will control how the learning of steering parameters is performed in the left and the right hearing aid. This is an example of a meta-parameter which is not part of the former categories. It may be tracked, based on running estimates of how consistent a user is in operating a control wheel. E.g. it could prove beneficial to use knowledge of the tracked aggressiveness in the left aid in tracking the aggressiveness in the right hearing aid.

The sixth embodiment encompasses any or all features from the first to the fifth embodiments involving steering parameters. However, any meta-parameter that determines the function of any hearing aid processing module should be captured. This could be a switch variable that determines the amount of symmetry in the left and right sounds fields that are being used in the left and right hearing aid to adapt the processing. Further, the non-steering situation should be included as well, i.e. a fixed but modifiable, via personalization, meta-parameter that does not change with environment should fall under this embodiment as well.

In FIG. 13 is shown a plot of a person's hearing loss in the right (R) and left (L) ear respectively, as a function of frequency. In the plots the hearing threshold T(R) and T(L) for a given frequency f_0 is shown. For the given frequency f_0 the perceived loudness for the right and left ear is shown as a function of input sound pressure level (SPL) in the two plots in FIG. 14.

Looking at the plots in FIGS. 13 and 14 it is clear that in order to achieve the same perceived loudness of sound at the frequency f_0 a higher input SPL is needed in the left ear as compared to the right ear. In order for the person to perceive the same loudness in the left and right ear it is necessary to incorporate the model of the hearing loss of the individual in the model 24.

The following is a non-exhaustive list of examples of hearing aid parameters, $\theta_t^L$ and $\theta_t^R$, that may be synchronized using the method for asymmetric synchronization in any of the embodiments. The list of suitable parameters include: left and right classifier outputs, volumes, noise reduction parameters, beam forming parameters, feedback suppression parameters and the like. Of cause several of these parameters may be synchronized simultaneously.

The above features of the embodiments of the method may be combined in any way desirable.

In one embodiment, one may think of a synchronized feedback suppression. Here we imagine a left and right hearing aid that each includes feedback suppression parameters that determine the feedback suppression to be applied. E.g. in the form of a switch variable in the case of strong periodicity, such as the presence of a pure tone, that is present in both sound fields, and zero if this is not the case. Two periodicity feature extraction procedures $FE_L$ and $FE_R$ could be applied to both left and right hearing aids (see FIG. 2), and a combination unit $FE_{LR}$ could output a switch variable to both hearing aids, that is one for binaural periodicity and zero otherwise. Each of the hearing aids could then use this estimate of the amount of binaural periodicity to determine whether a periodic sound inside one of the hearing aid is due to internal feedback or due to an external tonal input.

In another embodiment, a hearing aid system could be supplied with a method to detect a telephone near a hearing aid. This detection could e.g. be done by modeling and detecting the typical feedback path that is caused by holding a phone near the ear, or by letting the user manually specify the 'phone situation' via some interface to the hearing aid. When the phone detection variable for the left hearing aid is 1, which could be viewed as an output of a feature extraction unit $FE_L$, whereas the phone detection variable is zero for the right hearing aid, the synchronization mode in the hearing aid system could be temporarily switched to a special 'phone-in-one-ear mode'.

Conceptually, it would mean that the hearing aid system would switch to an asymmetric mode, where the setting for the steering parameters $\beta_t^L$ drives a high-amplification, high-feedback reduction and high-directional mode and the $\beta_t^R$ setting is driving a low-amplification, omni-directional mode. When the phone-in-one-ear mode has ended, the hearing aid system could then go back to the 'default asymmetry' mode.

In a third embodiment, one can think of a synchronized system of learning controls, where the learning control in each of the ears is synchronized at the level of the steering parameters. For example, a user may want a left hearing aid Learning Volume Control setting, that is determined by personalized steering coefficients $\beta_t^L$, that is the same as the setting $\beta_t^R$ for the right LVC. This is implemented by the second embodiment when the output vector $$\begin{bmatrix} \theta_k^L \\ \theta_k^R \end{bmatrix}$$

of the hearing aid system contains left and right volumes, respectively. Hence, the user only experiences gain differences when the sounds fields are different in left and right hearing aids. The resulting sound processing may be more reflecting the users preferred processing. Furthermore, operating one of the volume wheels of the hearing aid system will lead to learning in both steering parameters of the system, hence lead to adjustments of the volume in the (non-operated) hearing aid as well.

In yet another embodiment one may consider an initial asymmetric fit of directionality parameters in both hearing aids as an initial extreme case of binaural soft-switching directionality. Here, one of the hearing aids (e.g. the left) is allowed to switch and the other, the right in this example, is not allowed to switch, but it will stay in omnidirectional mode all the time. This is conceptually equivalent to setting some left directionality switching threshold, a steering parameter $\beta_t^L$, to some reasonable value and setting the threshold of the other hearing aid $\beta_t^R$ to infinity. The user may then adjust this initial, fully asymmetric, setting of the hearing aid system by manipulating, and thereby personalizing, the left and right steering parameters, that represent thresholds. Hence, a user can customize the asymmetry in the directionality switching behavior and make it depend on the acoustic environment. Furthermore, the initial choice of 'good ear', getting directional input, i.e. have a low switching threshold, and 'bad ear', getting omnidirectional input, i.e. infinite switching threshold, may be modified by the user, e.g. in the particular situation that a source of interest is coming from only from the side of the bad ear.

The invention claimed is:

1. A method of adjusting a signal processing parameter for a first hearing aid and a second hearing aid forming parts of a binaural hearing aid system to be worn by a user, the binaural hearing aid system comprising a user specific model representing a desired asymmetry between a first ear and a second ear of the user, the method comprising:

detecting a request for a processing parameter change at the first hearing aid, wherein the request is detected by the first hearing aid;

adjusting the processing parameter in the first hearing aid; and adjusting a processing parameter for the second hearing aid in response to the request for the processing parameter change detected by the first hearing aid, wherein the processing parameter for the second hearing aid is adjusted based on the user specific model.

2. The method according to claim 1, wherein the model representing the desired asymmetry comprises a measured and/or estimated hearing loss in the first ear and/or the second ear of the user.

3. The method according to claim 1, wherein the model incorporates a asymmetry in the first ear and second ear of the user.

4. The method according to claim 1, wherein the request for the processing parameter change results from the user operating an actuator or is generated in response to a change in a signal characteristic.

5. The method according to claim 1, wherein the model is a frequency dependent hearing loss model.

6. The method according to claim 1, wherein the processing parameter for the second hearing aid is a volume level, a noise reduction, a compression ratio, a time constant, a parameter of a classifier module, or a combination thereof.

7. The method according to claim 1, wherein the request for the processing parameter change comprises information regarding one or more processing parameters to be changed, and information regarding an amount of change or information regarding a value to which the parameter is changed.

8. The method according to claim 1, wherein the first hearing aid is a master device and the second hearing aid is a slave device.

9. The method according to claim 1, wherein the model comprises two steering vectors associated with a hearing loss in the first ear and a hearing loss in the second ear, respectively, wherein the steering vectors are coupled by a probability model representing the binaural hearing aid system.

10. The method according to claim 1, wherein the model is adjustable in response to one or both of the adjustment of the processing parameter in the first hearing aid and the adjustment of the processing parameter in the second hearing aid.

11. The method according to claim 1, wherein an overall degree of asymmetry depends on a difference between respective microphone recordings in the first hearing aid and second hearing aid.

12. A hearing aid comprising a signal processor, wherein the hearing aid is configured for forming a part of a binaural hearing aid system and for receiving information from another hearing aid that is also configured to form a part of the binaural hearing aid system, wherein the signal processor is configured to adjust a signal processing parameter in the hearing aid in response to a request for a processing parameter change detected in the other hearing aid, wherein the signal processor is configured to adjust the signal processing parameter based on a specific model representing a hearing loss of a user.

13. The hearing aid according to claim 12, wherein the model comprises a measured and/or estimated hearing loss in a first ear and/or a second ear of the user.

14. The hearing aid according to claim 12, wherein the model incorporates an asymmetry in the first ear and second ear of the user.

15. The hearing aid according to claim 12, wherein the request for the processing parameter change results from the user operating an actuator or is generated in response to a change in a signal characteristic.

16. The hearing aid according to claim 12, wherein the model is a frequency dependent hearing loss model.

17. The hearing aid according to claim 12, wherein the processing parameter for the hearing aid is a volume level, a noise reduction, a compression ratio, a time constant, a parameter of a classifier module, or a combination thereof.

18. The hearing aid according to claim 12, wherein the request for the processing parameter change comprises information regarding one or more processing parameters to be changed, and information regarding an amount of change or information regarding a value to which the parameter is changed.

19. The hearing aid according to claim 12, wherein the other hearing aid is a master device and the hearing aid is a slave device.

20. The hearing aid according to claim 12, wherein the model comprises two steering vectors associated with a hearing loss in the first ear and a hearing loss in the second ear, respectively, wherein the steering vectors are coupled by a probability model representing the binaural hearing aid system.

21. The hearing aid according to claim 12, wherein the model is adjustable in response to one or both of an adjustment of the processing parameter in the hearing aid and an adjustment of the processing parameter in the other hearing aid.

22. The hearing aid according to claim 12, wherein an overall degree of asymmetry depends on a difference between respective microphone recordings in the hearing aid and other hearing aid.

23. The method according to claim 9, further comprising updating the probability model using a Bayesian framework.

24. The method according to claim 1, further comprising incorporating an adjustment of the processing parameter for the second hearing aid by the user into the model.

25. The method according to claim 24, wherein the act of incorporating the adjustment of the processing parameter for the second hearing aid by the user into the model is performed if the adjustment of the processing parameter for the second hearing aid is performed by the user within a predefined time interval from a time when the request for the processing parameter change at the first hearing aid is detected.

26. The method according to claim 1, wherein the processing parameter for the second hearing aid is adjusted automatically without user input.

27. The hearing aid according to claim 20, wherein the probability model is configured to be updated using a Bayesian framework.

28. The hearing aid according to claim 12, wherein the model is configured to incorporate an adjustment of the processing parameter for the hearing aid by the user.

29. The hearing aid according to claim 28, wherein the model is configured to incorporate the adjustment by the user if the adjustment of the processing parameter for the hearing aid is performed by the user within a predefined time interval from a time when the request for the processing parameter change in the other hearing aid is detected.

30. The hearing aid according to claim 12, wherein the signal processor is configured to adjust the signal processing parameter automatically without user input.

* * * * *